United States Patent [19]

Allbert et al.

[11] Patent Number: 4,493,862

[45] Date of Patent: Jan. 15, 1985

[54] ORNAMENTAL ASSEMBLY AND METHOD

[76] Inventors: James C. Allbert; Helen M. Allbert, both of 151 Pleasant View Rd., Derby, Conn. 06418

[21] Appl. No.: 582,391

[22] Filed: Feb. 24, 1984

[51] Int. Cl.[3] ..... A41G 1/04; A47G 33/00

[52] U.S. Cl. ..... 428/10; 29/451; 29/525; 29/526 R; 428/11; 428/27

[58] Field of Search ..... 428/10, 11, 27; 29/451, 29/525, 526 R

[56] References Cited

U.S. PATENT DOCUMENTS

| | | | |
|---|---|---|---|
| 1,141,317 | 6/1915 | Correa | 428/11 X |
| 1,329,615 | 2/1920 | Langfelder | 428/11 |
| 2,243,764 | 5/1941 | Miles, Jr. | 428/11 X |
| 3,079,681 | 3/1963 | Fentiman | 29/525 |
| 3,272,976 | 9/1966 | Charchan et al. | 428/11 X |
| 3,350,555 | 10/1967 | Di Rico | 428/10 X |
| 3,473,247 | 10/1969 | La Favor et al. | 428/11 X |
| 3,513,534 | 5/1970 | Bradley et al. | 29/525 X |
| 3,549,465 | 12/1970 | Skelley, Jr. | 428/11 |

*Primary Examiner*—Henry F. Epstein

*Attorney, Agent, or Firm*—Thomas L. Tully

[57] ABSTRACT

An ornamental assembly comprising a supporting core and a plurality of similar radially-extending decorative elements each having an attachment end securable to said core and a decorative end supported a fixed distance from said core. The core contains a sufficient number of uniformly-spaced radially-extending retainer means to receive a sufficient number of decorative elements of such dimensions as to produce a substantially round ornamental assembly having a central core which is concealed by a uniformly-radially-extended surface comprising the decorative ends of said decorative elements.

20 Claims, 5 Drawing Figures

ORNAMENTAL ASSEMBLY AND METHOD

BACKGROUND OF THE INVENTION

The present invention relates to an improved method for assembling novel ornamental articles of relatively large size for decorative purposes and occasions, such as for use as Christmas or other holiday decorations in the home, office, restaurants, etc., or for use as reflective decorations in dance halls or similar places.

Prior-known ornamental articles of relatively large size are known, such as round balls having a diameter of about 10 inches or more and having smooth or multibulbous or multifaceted surfaces. Such articles generally are hollow or of solid foam or other material and are formed of one piece construction or of two halves which are united to form the article. In some cases, such as multifaceted reflective ornaments, the ornamental outer surface is formed by adhering a plurality of polygonal mirror pieces to said surface.

Such prior-known ornamental articles generally are expensive, difficult to manufacture, cumbersome to store away, have a fixed, nonvariable appearance and do not have parts which can be replaced easily if damaged.

SUMMARY OF THE INVENTION

The novel ornamental articles of the present invention are easily assembled, and disassembled if desired, and comprise a plurality of inexpensive, replaceable and easily stored decorative elements having different colors or decorative appearances, which elements are interchangeable with respect to their locations of attachment to the central support core so that they can be attached in any desired relationship to each other to produce any desired variable decorative appearance or color pattern.

THE DRAWING

Figure 1:
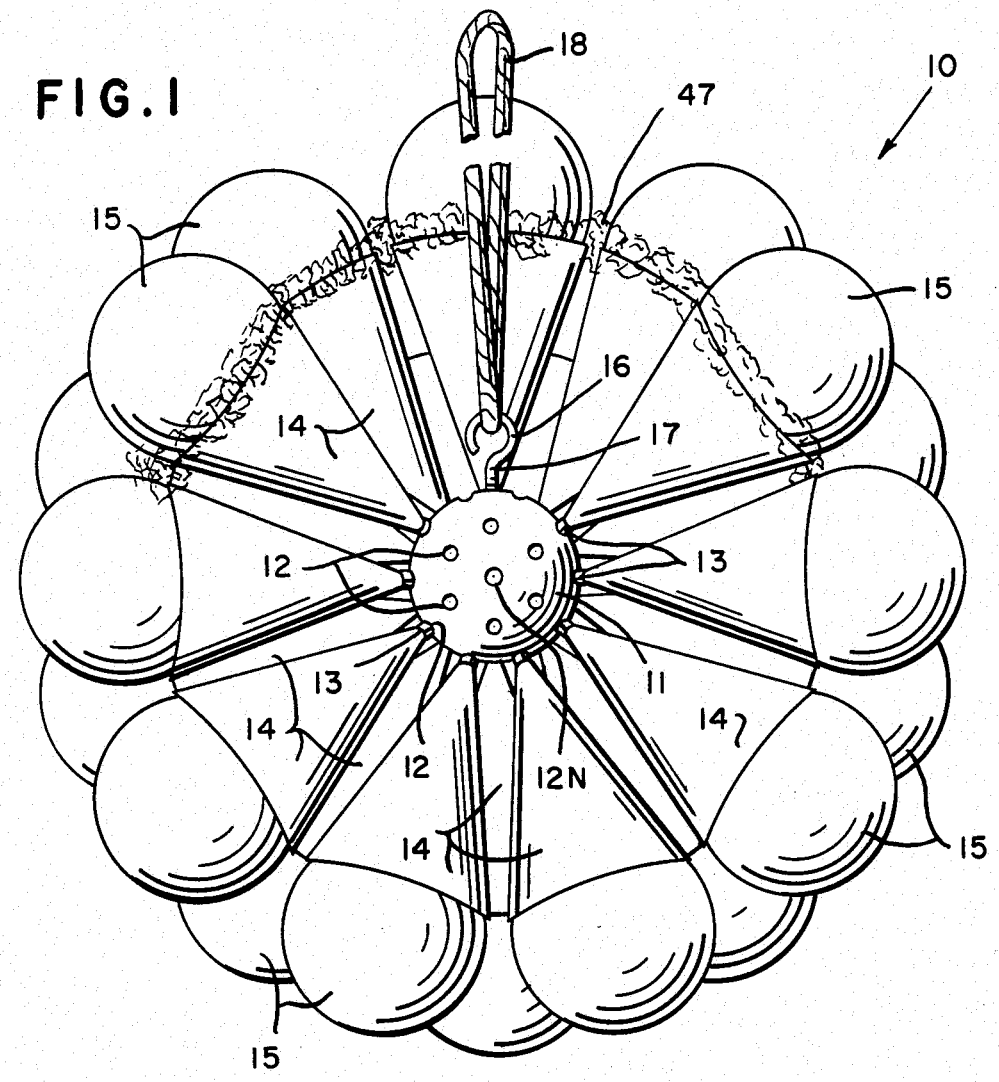
FIG. 1 is a side view of an ornamental assembly according to one embodiment of the present invention, shown at about ½ scale, several decorative insert elements being removed for purposes of illustrating the central support core, a hanger ring, and the structure and attachment of the insert elements.

Referring to the drawing, the novel ornamental assembly 10 of FIG. 1 comprises as a central support core 11 a solid sphere having a plurality of uniformly spaced radially-extending bores 12, each of which is designed to receive and tightly engage the attachment end 13 of a decorative insert element 14 having an enlarged decorative end 15, such as a colored ball. The assembly 10 of FIG. 1 illustrates a decorative insert element 14 engaged within each of the bores 12 except for the central bore 12N, the ring of bores 12 adjacent thereto and the two top bores in the next ring from which the ornamental elements 14 normally present therein have been removed for illustration purposes. FIG. 1 also illustrates the presence of a hanger support ring 16 having a stem 17 attached to the core 11 and a hanger cord 18 to permit the ornamental element 10 to be suspended for display purposes.

Figure 2:
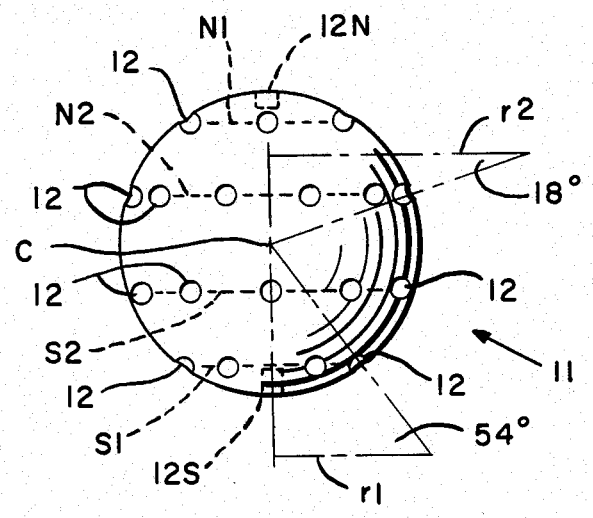
FIG. 2 is a top view of the central support core of FIG. 1, shown at about full scale, prior to the attachment of any of the insert elements.

The central support core 11, per se, is illustrated in FIG. 2 by means of a top view showing the side location of bore 12N. The bores 12 are positioned and formed by first marking a pair of diametrically-opposite points on the solid core 11 and drilling or otherwise forming the opposed radial bores 12N and 12S. Then a circumferential line 19 is drawn between the centers of bores 12N and 12S, referred to as a longitude line. Next, four latitude lines N1, N2, S2 and S1 are drawn to intersect the longitude line 19 at positions which are 36°, 72°, 108° and 144°, respectively, around the core 11 from the center of the bore 12N. Thus, circumferential latitude lines N1 and S1 are equidistant at 36° from the bores 12N and 12S, respectively, and lines N2 and S2 are equidistant at 72° from the bores 12N and 12S, respectively, each of the lines N1, N2, S1 and S2 being equidistant from an adjacent latitude line or from adjacent bores 12N or 12S by 36° longitude. Next, the latitude lines N1 and S1 are each marked and drilled or otherwise provided with six radial bores 12 which are equally spaced from each other by 60° latitude. The locations of the bores 12 around line N1 are determined by centering the first bore 12 on the longitude line 19. The locations of the bores 12 around line S1 are determined by centering the longitude line 19 between a pair of bores 12. The same procedure is followed for lines N2 and S2 except that ten radial bores 12 are marked and formed around each of these lines, spaced 36° latitude from each other, a bore 12 on line S2 being centered on line 19 and line 19 being centered between a pair of bores 12 along line N2. This provides the core 11 with a plurality of uniformly-spaced radial bores 12 over the entire periphery of the round core 11.

The bores 12, including 12N and 12S, are formed to extend an equal distance into the core 11 so as to receive and retain the identical attachment ends 13 of the plurality of decorative elements 14 in any desired manner, such as by frictional engagement, threaded engagement or otherwise. The illustrated decorative elements 14 have an ice cream cone shape and appearance and are conveniently formed by providing a hollow cone, such as a paper cup or a molded cone, with a central attachment end 13 such as a wooden dowel or threaded bolt end secured through the vertex of the cone, and with a decorative end 15, such as a conventional round tree ornament having a diameter at least slightly larger than the open end of the cone, the ornament being secured to the cone, with the conventional hanger portion of the ornament concealed within the cone. The assembly 10 illustrated by FIG. 1 and the core 11 of FIG. 2 are designed to accommodate thirty-four decorative elements 14 to provide an enlarged decorative sphere having an outer surface consisting of the rounded ornament ends 15 which are in contacting or closely-spaced relation to each other to conceal the central core 11.

The ornamental appearance of the assembly can be formed and modified to suit the user by using decorative ends 15 of the same or different colors. A favorable appearance is produced by using identical decorative ends 15, such as silver or gold colored balls, on the elements 14 secured within bore 12N and within the bores 12 along latitude lines N2 and S1, and by using different decorative ends 15, such as blue or red colored balls, on the elements 14 secured within bore 12S and within the bores 12 along latitude lines S2 and N1. This provides a hexagonal design on opposite sides of the final assembly comprising decorative ends 15 of different colors, secured within the 12N and 12S bores respectively, with six decorative ends 15 of the contrasting color surrounding each in a hexagonal design.

Figure 3:
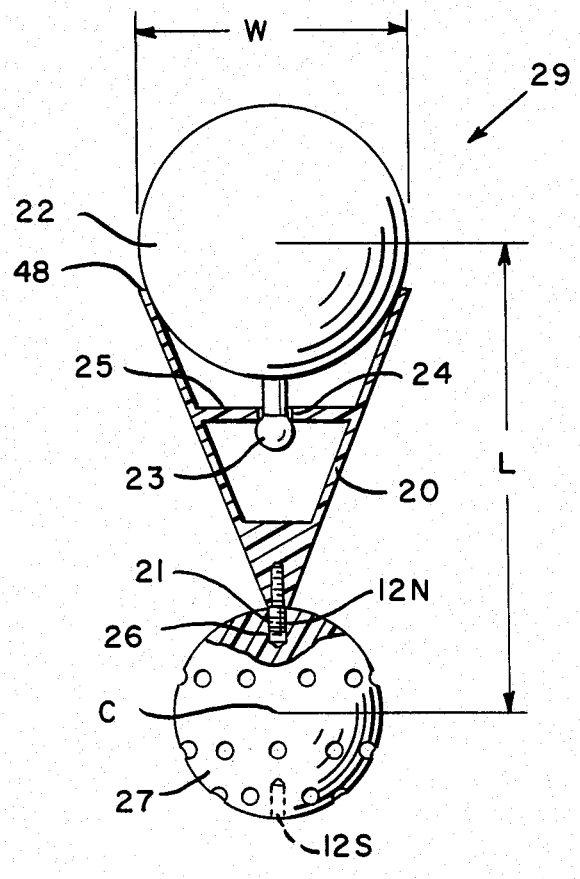
FIG. 3 is a cross-sectional view of a single insert element of one particular structure, threadably engaged to a central support core, according to an embodiment of the present invention.

The ornamental elements 14 used to form the present assemblies 10 may be unitary molded elements or may be made by assembling the component parts. FIG. 3 illustrates a cross-section of a cone body support 20, having a threaded bolt attachment end 21, axially bonded through the vertex end or point of the cone body support 20, and a plastic ball ornament 22 having a projection end 23 designed to snap into a central hole 24 in a retainer wall 25 within the cone body section 20 to provide a decorative element 29. This permits ball ornaments 22 of different colors to be used interchangeably, or to be replaced if breakage occurs, while retaining the same cone body portion. Cone body support 20 may be molded in two vertical half-sections and then assembled as a unit.

FIG. 3 illustrates the decorative element 29 threadably engaged within a threaded bore 26 of a support core 27, shown in partial sections.

Figure 4:
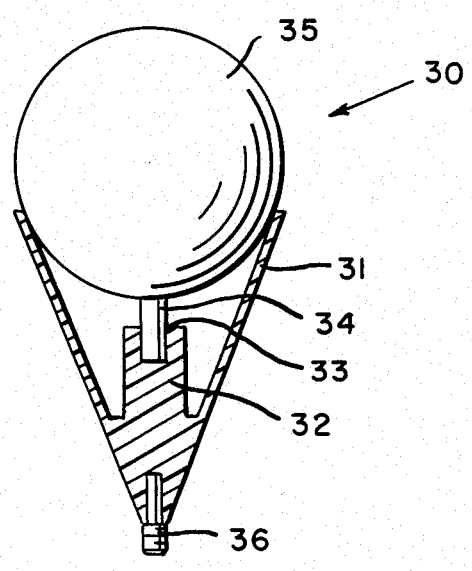
FIG. 4 is a cross-sectional view of the support cone of an insert element of another structure, according to another embodiment of the present invention.

FIG. 4 illustrates another suitable structure for a decorative element 30 having a cone body support 31 which can be molded conveniently in one piece. The support 31 contains an inner axial post 32 having a central bore 33 adapted to make frictional engagement with a radially-extending projection 34 present on the surface of a decorative ball 35, whereby balls 35 of different colors can be interchanged within the same support cone 31. As in FIG. 3, the vertex of the cone 31 has axially-secured therewithin a threaded bolt attachment end 36 designed to threadably engage within a threaded bore of a central core such as 27 of FIG. 3

Figure 5:
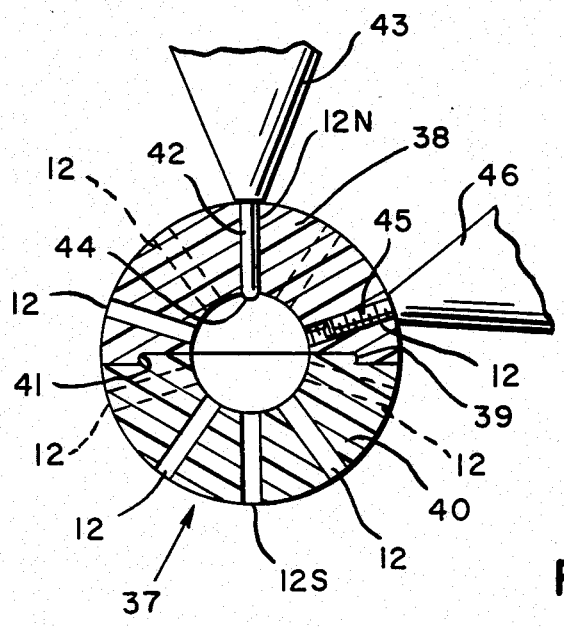
FIG. 5 is a cross-sectional view of a two-piece hollow core shown with portions of one frictionally-engaged and one threadably-engaged insert element, for illustration purposes.

FIG. 5 illustrates a suitable design for a two piece hollow central support core 37 comprising a core half 38 provided with a circular recess 39 and a core half 40 provided with a circular raised bead 41, the bead 41 nesting within the recess 39 when the halves are pressed together to form the core unit 37. The illustrated core 37 has a diameter of about 2¼ inches, a wall thickness of about ½ inch and a center recess having a diameter of about 1¼ inches. The radial bores 12 are numbered and positioned as in the view of the core 11 of FIG. 2, so that all of the bores 12 are on the plane of the cross-section except for those in the N1 and S2 latitude lines which are shown in broken lines. All of the bores 12 are drilled completely through the walls of the halves 38 and 40, as illustrated.

The attachment end 42 of one cone 43 comprises a smooth round plastic pin having a rounded tip 44 for ease of insertion into frictional engagement within a smooth bore 12. The attachment end 45 of the other cone 46 comprises a threaded round metal pin or bolt end for threaded engagement within a threaded bore 12. Generally, all of the bores 12 on a particular core will be either threaded or smooth.

It will be evident to those skilled in the art that the present decorative elements 14, 29 or 30 need not have a conical body as illustrated by FIGS. 1 and 4. The essential requirement is that the decorative end thereof is substantially wider than the attachment end so that a plurality of such elements can be attached to a relatively small round core to produce a relatively large round ornamental assembly. The dimensions of the decorative elements 14, 29 and 30 are determined in association with the dimensions of the support core 11 or 27. Thus, the elements 14, 29 and 30 can have any desired reasonable length, from the outer surface of the decorative end 15 to the vertex of the cone and the core can have any desired reasonable diameter. Generally, the core will have a diameter between about 1½ and 5 inches, preferably 2 to 4 inches, and the elements 14, 29 and 30 will have a length between about 3 and 10 inches, preferably 4 to 6 inches. The most critical dimension of the decorative elements is the width of the decorative end or ball thereof since it is the decorative ends which must substantially fill or occupy the outer surface of the ornamental assembly and conceal the central core. Such width W of each ornamental end 22, shown in FIG. 3, depends upon the number of elements 29 present along the latitude lines N2 or S2 and the length of the elements 29 from the point of maximum width W to the center C of the support core, as shown by FIG. 3. Since the length L will equal the slant height of an imaginary enlarged cone, the frustrum circumference of which comprises the ornamental outer surface of the final assembly at the point of maximum width of the decorative ends or balls 22, the frustrum circumference will equal $\pi$ times the diameter of the frustrum, and the maximum width W will equal the circumference divided by the number of elements present along line N2 or along line S2, i.e., ten in the illustrated embodiment.

FIG. 2 illustrates one-half of the imaginery cones formed by angles at which the decorative elements in each of lines N1 and S1 and in each of lines N2 and S2 extend, from the center of the core 11 to the point of maximum width of the decorative ends 15 of elements 14. The length of r1, the radius of the frustrum for lines N1 and S1 equals the slope length times the cosine of the outer angle which is 54°, or 180°−(90°+36°). The length of r2, the radius of the frustrum for lines N2 and S2 equals the slope length times the cosine of the outer angle which is 18°, or 180°−(90°+72°). In cases where the slope length, shown as L in FIG. 3, equals 5", r1 equals 2.94" and r2 equals 4.75". Thus, the frustrum circumference for lines N1 and S1 equals 18.46" and for lines N2 and S2 equals 29.88". In the illustrated embodiment lines N1 and N2 comprise six decorative elements 14 so that the maximum diameter of each, or width W in FIG. 3, equals 18.46÷6, or about 3", and lines N2 and S2 comprise ten decorative elements 14 so that the maximum diameter of each, or width W, equals 29.88 ÷10 or about 3". Obviously, if the number of decorative elements, or their length L, is varied by varying the number of bores 12 along the latitude lines N1, N2, S2 or S1, the maximum width W of the decorative ends 15, 22 or 35 of the elements 14, 29 or 30 must be increased or decreased in order to provide a decorative outer surface in which the decorative ends 15, 22 or 35 are in contact with each other or closely spaced from each other so as to conceal the central core 11 or 27.

In cases where the decorative ends 15, 22 or 35 have a flat, hexagonal outer surface, rather than being round and circular across the width W, a substantially continuous multi-faceted ornamental outer surface can be produced.

It will be evident to those skilled in the art that the present decorative insert elements 14 may be molded as unitary elements which include both an attachment end 13 and a decorative end 15. Alternatively, the cone supports, such as 20 of FIG. 3 or 31 of FIG. 4, may be molded without the interior ball-attachment means 24 and 32 but may be provided with snap-attachment means or adhesive around the circumference of the frustrum of the cone 20 and 31 for attachment to a decorative ball or ball segment to form the decorative end thereof.

Also, the central support core may be a solid sphere, such as a billiard ball, as shown in FIGS. 1 and 3, or a hollow sphere comprising molded plastic hemispheres which are glued together or snapped together as shown by FIG. 5. However, if the sphere is hollow, it must have a wall thickness approximately the length of the attachment ends of the decorative elements.

As is clear from the foregoing description, the novel ornamental assemblies of the present invention may be produced in a variety of different sizes and can be assembled to produce a variety of different ornamental appearances by changing the colors or shapes of the decorative elements inserted into the various bores in the central support core. Also, according to a preferred embodiment a conventional continuous tinsel garland cord 47 can be applied over the entire ornamental outer surface of the assembly 10, a portion of such garland 47 being illustrated by FIG. 1. The garland 47, generally formed from a multiplicity of fine metallized strands wrapped around a support string or cord, is gently pressed between and around the contacting or adjacent surfaces of the decorative ends 15 of elements 14 where it is held in loose frictional engagement to fill any spaces and hide the cone bodies and central core from view.

While the present ornamental assemblies have a substantially round shape, due to the decorative elements extending a substantially equal distance from the center of the support core in all directions, it should be understood that the assembly may be provided with a flat base surface or with a support stand, attached to the core, which may be provided with music means and/or rotation means, similar to a music box. Also, one or more of the decorative elements 14 may contain music means and/or rotation means so that the assembly can be suspended therefrom to rotate and/or to emit music. Lights may be directed upon the suspended rotating assembly to provide a pleasant effect, particularly where the decorative ends 15 have light-reflective, mirrored surfaces, round or flat, of different colors.

It is noted that the garland 47 is supported at the surface of the present ornamental assemblies by frictional engagement with the decorative ends 15 and also by means of the circumferential lip at the frustrum of the cone body, as shown by lip 48 on the cone body 20 of FIG. 3. Alternatively, each decorative element 14 may be provided with its own individual garland ring secured thereto around the lip area where the decorative end 15 meets the cone body.

Variations and modifications of the present invention will be apparent to those skilled in the art within the scope of the present claims.

We claim:

1. An enlarged ornamental assembly of substantially spherical shape comprising a plurality of elongate decorative elements having similar dimensions and a small central support core designed to receive and support said decorative elements in radial extension in all directions therefrom, said central support core comprising a plurality of geometrically-located retainer means which extend radially thereto in all directions and which are substantially-uniformly spaced over the surface of said core, said elongate decorative elements each comprising a hollow conical body portion having a narrow attachment end received and supported in radial extension by a said retainer means of said core, and an enlarged decorative end spaced from said attachment end adjacent the frustrum of the conical body portion, there being a sufficient number of retainer means and elongate decorative elements to support enough decorative ends of sufficient dimensions to provide an enlarged decorative sphere surface comprising said decorative ends closely-spaced from or contacting each other to substantially completely hide the small central support core.

2. An assembly according to claim 1 in which said core comprises a solid sphere having a plurality of radial bores forming said retainer means.

3. An assembly according to claim 2 in which said bores are designed to frictionally-engage the narrow attachment ends of the decorative elements.

4. An assembly according to claim 2 in which said bores are provided with thread means to threadably-engage the narrow attachment ends of the decorative elements which are provided with companion thread means.

5. An assembly according to claim 1 in which the retainer means are geometrically-located on said core by providing a pair of diametrically-opposed retainer means at the poles thereof and a multiplicity of retainer means along an even number of latitude lines which are uniformly-spaced from each other around said core, the retainer means in each said line being uniformly spaced from each other.

6. An assembly according to claim 1 in which each said decorative end comprises a decorative sphere having a diameter or width greater than the diameter of the frustrum of the conical body portion, said sphere being attached in centered position within the conical body portion to extend above the frustrum.

7. An assembly according to claim 6 in which said decorative sphere is releasably-attached to said conical body portion.

8. An assembly according to claim 1 in which said elongate decorative elements have decorative ends of different colors so that the attachment of said decorative elements to different retainer means changes the appearance of the enlarged decorative sphere surface formed by said decorative ends.

9. An assembly according to claim 1 in which said core is also provided with means for attachment to a cord to enable the assembly to be suspended.

10. An assembly according to claim 1 in which the enlarged decorative sphere surface also comprises a decorative garland cord which contacts and conceals the frustrum of each of the conical body portions and encircles each of said decorative ends to fill any spaces therebetween.

11. Method for producing an enlarged ornamental assembly of substantially spherical shape from a small central support core comprising the steps of:

(a) providing said central support core with a plurality of substantially uniformly-spaced, geographically-located retainer means which are geometrically-located over the surface of said core and which extend radially therefrom in all directions;

(b) providing a plurality of elongate decorative elements having similar dimensions, each said element comprising a hollow concial body portion having a narrow attachment end designed to be received and supported in radial extension by a said retainer means of said core, and an enlarged decorative end spaced from said attachment end adjacent the frustrum of the conical body portion, and (c) attaching an attachment end of an elongate decorative element into each of the retainer means of the central support core to enclose said core within a plurality of radially-extending decorative elements, the decorative ends of which are radially-extended a uniform distance above said core in all directions to form an enlarged decorative sphere surface comprising said decorative ends which are closely-spaced from or contacting each other to substantially completely hide the small central support core.

12. Method according to claim 11 which comprises forming the retainer means in said core by forming radially-extending bores therein.

13. Method according to claim 11 in which said retainer means are geographically-located by forming a pair of diametrically-opposed retainer means at the poles of the core, and forming a multiplicity of retainer means along an even number of latitude lines which are uniformly spaced from each other around said core, the retainer means in each said line being uniformly spaced from each other.

14. Method according to claim 13 in which the retainer means are formed around four latitude lines, each spaced from the next or from the poles by 36° longitude, the latitude lines nearest the poles containing six retainer means each and the other latitude lines containing ten retainer means each.

15. Method according to claim 11 in which each said decorative end comprises a decorative sphere having a diameter greater than the diameter of the frustrum of the conical body portion, said sphere being attached in centered position within the conical body portion to extend above the frustrum.

16. Method according to claim 15 in which said sphere is attached to said conical body portion by means of releasable attachment means.

17. Method according to claim 11 in which the attachment ends of the decorative elements are attached to the retainer means by frictional engagement therein.

18. Method according to claim 11 in which said retainer means and the attachment ends of said decorative elements are provided with companion thread means to provide threaded attachment therebetween.

19. Method according to claim 11 in which a hanger element is attached to the central support core to enable the ornamental assembly to be suspended.

20. Method according to claim 11 which comprises attaching a decorative garland over the enlarged decorative sphere surface to contact and conceal the frustrum of each of the conical body portions and to surround each of said decorative ends and fill the spaces therebetween.

* * * * *